US007992236B2

(12) United States Patent
Degooyer

(10) Patent No.: US 7,992,236 B2
(45) Date of Patent: Aug. 9, 2011

(54) MOCK SHOWER DRAIN AND ASSOCIATED METHODS

(75) Inventor: Lonnie C. Degooyer, South Jordan, UT (US)

(73) Assignee: Schluter Systems, L.P., Plattsburgh, NY (US)

( * ) Notice: Subject to any disclaimer, the term of this patent is extended or adjusted under 35 U.S.C. 154(b) by 1084 days.

(21) Appl. No.: 11/366,203

(22) Filed: Mar. 1, 2006

(65) Prior Publication Data

US 2007/0204399 A1 Sep. 6, 2007

(51) Int. Cl.
*E03C 1/12* (2006.01)

(52) U.S. Cl. ..... 4/679; 4/613; 4/652; 4/287

(58) Field of Classification Search ..... 4/679, 652, 4/613, 287

See application file for complete search history.

(56) References Cited

U.S. PATENT DOCUMENTS

| | | | | |
|---|---|---|---|---|
| 1,782,737 A | | 11/1930 | Mahon | |
| 2,222,807 A | | 11/1940 | Burr | |
| 2,299,705 A | * | 10/1942 | Svirsky | 4/613 |
| 2,672,205 A | * | 3/1954 | McDonald | 4/613 |
| 3,668,718 A | | 6/1972 | Cuschera | |
| 3,744,065 A | * | 7/1973 | Yavitch | 4/613 |
| 3,839,752 A | * | 10/1974 | Brown et al. | 4/629 |
| 3,896,511 A | | 7/1975 | Cuschera | |
| 4,067,072 A | | 1/1978 | Izzi | |
| 4,092,745 A | | 6/1978 | Oropallo | |
| 4,099,274 A | | 7/1978 | Emberson | |
| 4,123,810 A | | 11/1978 | Oropallo | |
| 4,146,939 A | | 4/1979 | Izzi | |
| D260,170 S | | 8/1981 | Cornwall | |
| D263,866 S | | 4/1982 | Messenger | |
| D273,413 S | | 4/1984 | McMurray | |
| 4,455,693 A | | 6/1984 | Cuschera | |
| 4,562,602 A | | 1/1986 | Cuschera | |

(Continued)

FOREIGN PATENT DOCUMENTS

DE 2 035 199 1/1972

(Continued)

OTHER PUBLICATIONS

Plank, U.S. Appl. No. 29/301,925, filed Mar. 20, 2008.

(Continued)

*Primary Examiner* — Khoa D Huynh

(74) *Attorney, Agent, or Firm* — Thorpe North & Western LLP

(57) ABSTRACT

A mock shower drain for temporary, in-situ installation within a shower area that is configured to utilize an integrated bonding flange drain, the mock shower drain includes a lower section operable to mate with a drain fitting installed in the shower area, the drain fitting operable to mate with a corresponding lower section of an integrated bonding flange drain. An upper section is sized to fit within a cavity formed in a subfloor of the shower area sized to receive a corresponding section of the integrated bonding flange drain. A cap section is coupled to the upper section, the cap section forming a barrier to resist passage of debris to the drain fitting. An intermediate section intercouples the upper section and the cap section. The mock drain is dimensioned such that an uppermost portion of the mock drain is elevated at least as high as to be substantially flush with the subfloor of the shower area when the lower section of the mock drain is mated with the drain fitting.

13 Claims, 3 Drawing Sheets

U.S. PATENT DOCUMENTS

| | | | | |
|---|---|---|---|---|
| 4,694,513 | A | 9/1987 | Kiziah | |
| 4,883,590 | A | 11/1989 | Papp | |
| 5,216,767 | A * | 6/1993 | Elmore | 4/613 |
| D346,433 | S | 4/1994 | Cooper | |
| 5,333,432 | A | 8/1994 | Schluter | |
| D379,493 | S | 5/1997 | Woods | |
| 6,035,886 | A * | 3/2000 | Kerr | 4/695 |
| 6,085,362 | A * | 7/2000 | Huber | 4/252.4 |
| 6,212,709 | B1 | 4/2001 | Newton | |
| 6,350,373 | B1 | 2/2002 | Sondrup | |
| 6,381,775 | B1 | 5/2002 | Sondrup | |
| D468,001 | S | 12/2002 | Teskey | |
| 6,675,679 | B2 | 1/2004 | Dugan | |
| 2007/0056088 | A1 | 3/2007 | DeGooyer | |
| 2007/0113329 | A1 | 5/2007 | Luk | |

FOREIGN PATENT DOCUMENTS

| | | |
|---|---|---|
| DE | 2 315 574 | 10/1974 |
| DE | 3 442 178 | 5/1986 |
| DE | 4 000 511 | 7/1990 |
| DE | 3 907 832 | 9/1990 |
| DE | 4 013 775 | 11/1991 |
| DE | 4 206 512 | 9/1993 |
| WO | WO 2004/042155 | 5/2004 |

OTHER PUBLICATIONS

Degooyer, U.S. Appl. No. 12/205,105, filed Sep. 5, 2008.
Degooyer U.S. Appl. No. 11/498,537, filed Aug. 2, 2006.
Degooyer, U.S. Appl. No. 12/077,941, filed Mar. 20, 2008.
Ikz Haus Technik brochure, Aug. 19, 1985, 1 page.
http://www.schluter.com "Schluter Systems Profile of Innovation,"8.2 Schluter-Kerdi-Drain, Mar. 23, 2005, 4 pages, printed in Canada.
Shower Receptor Wood or Metal Studs, Schluter Systems, USA.
Schluter Systems "Schluter-Kerdi-Drain with integrated bonding flange for bonded waterproof membranes," www.shcluter.com, 2004, 2 pages.
U.S. Appl. No. 12/077,941; filed Mar. 20, 2008; Lonnie C. DeGooyer; office action issued May 20, 2011.
U.S. Appl. No. 12/205,105; filed Sep. 05, 2008; Lonnie C. DeGooyer; office action issued May 27, 2011.

* cited by examiner

MOCK SHOWER DRAIN AND ASSOCIATED METHODS

FIELD OF THE INVENTION

The present invention relates generally to drain fittings utilized in shower or bath installations.

BACKGROUND OF THE INVENTION

The construction of drain assemblies in tile shower installations has conventionally involved the use of a well-known, two-piece drain to which a shower pan is sealably attached beneath a mortar bed. The term "two-piece" drain is used because this type of drain typically includes at least two components that compress and seal the shower pan between the two components to secure the shower pan to the drain. Tile is typically applied over the mortar bed and the mortar bed serves as a conduit to direct water to the shower pan and the water is drained over the shower pan and into a waste drain through weep holes formed in sides of the two-piece drain.

Recently, a different type of assembly has become popular for use in shower floors that involves the use of a bonded (or bondable) waterproof membrane. In general, a bondable waterproof membrane bonds directly to the mortar bed (or a suitable equivalent) and protects the mortar bed (and any underlying structure such as the subfloor) from contact with moisture from the shower. The incorporation of bondable waterproof membranes in floor drain installations has generally required that drain fittings other than the conventional two-piece drains be developed. This is because conventional two-piece floor drains were designed to connect to shower pan liners below the mortar bed and so did not provide for a secure, watertight connection to bondable waterproof membranes at the top of the drain assembly.

For this reason, drain fittings having so-called "integrated bonding flanges" have been developed for use with bonded waterproof membranes. A typical integrated bonding flange installation is illustrated in FIGS. 1A and 1B. Because it is imperative that the bondable waterproof membrane form a watertight seal with the integrated bonding flange drain, these types of drains are typically provided with an upper bonding flange that has a relatively large surface area, such as that shown in FIG. 1A, to provide maximum surface area for adherence of the bondable waterproof membrane.

While the integrated bonding flange system has proved popular with tile installers (or "tile setters"), there exists a sometimes significant time delay between the time that a plumber installs the plumbing for the integrated bonding flange drain and the time at which a tile installer completes the tile shower installation utilizing the integrated bonding flange drain. As such, it is sometimes difficult for the plumber to properly ascertain the height at which the various components of the drainage system should be installed to ensure that the tile setter can properly complete the installation. In addition, as the integrated bonding flange drain protrudes some distance above the subfloor (it is actually seated on a bed of mortar, or equivalent structure, by the tile setter), the integrated bonding flange drain can be subject to being damaged during the intervening days, weeks or months after the plumber installs the drainage components and before the tile setter completes the installation.

Thus, while the bonded waterproof membrane shower system is increasing in popularity, problems have arisen relating to the discontinuity in time between the work performed by the plumber and the finished tile installation performed by the tile setter.

SUMMARY OF THE INVENTION

It has been recognized that it would be advantageous to develop a mock drain that can be utilized by a plumber to ensure accurate installation of an integrated bonding flange drain, and that aids in preventing the integrated bonding flange drain from becoming damaged prior to the finishing work performed by the tile setter.

Accordingly, the present invention provides a mock shower drain for temporary, in-situ installation within a shower area that is configured to utilize an integrated bonding flange drain. The mock shower drain can include a lower section operable to mate with a drain fitting installed in the shower area, the drain fitting operable to mate with a corresponding lower section of an integrated bonding flange drain. An upper section can be sized to fit within a cavity formed in a subfloor of the shower area sized to receive a corresponding section of the integrated bonding flange drain. A cap section can be coupled to the upper section, the cap section forming a barrier to resist passage of debris to the drain fitting. An intermediate section can intercouple the upper section and the cap section. The mock drain can be dimensioned such that an uppermost portion of the mock drain is elevated at least as high as to be substantially flush with the subfloor of the shower area when the lower section of the mock drain is mated with the drain fitting.

In accordance with another aspect of the invention, a method for preparing a shower area to receive an integrated bonding flange drain prior to installing the integrated bonding flange drain is provided, including: ensuring that suitable plumbing exists below a subfloor of the shower area to accommodate the integrated bonding flange drain, the plumbing including at least a drain fitting operable to mate with a lower section of the integrated bonding flange drain; ensuring that a suitable opening is formed in the subfloor through which the integrated bonding flange drain can be disposed when accommodated by the plumbing; temporarily installing within the drain fitting a lower section of a mock drain; and orienting an upper section of the mock drain such that an uppermost section of the mock drain is elevated at least as high as to be substantially flush with the subfloor of the shower area when the lower section of the mock drain is mated with the drain fitting.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1A:
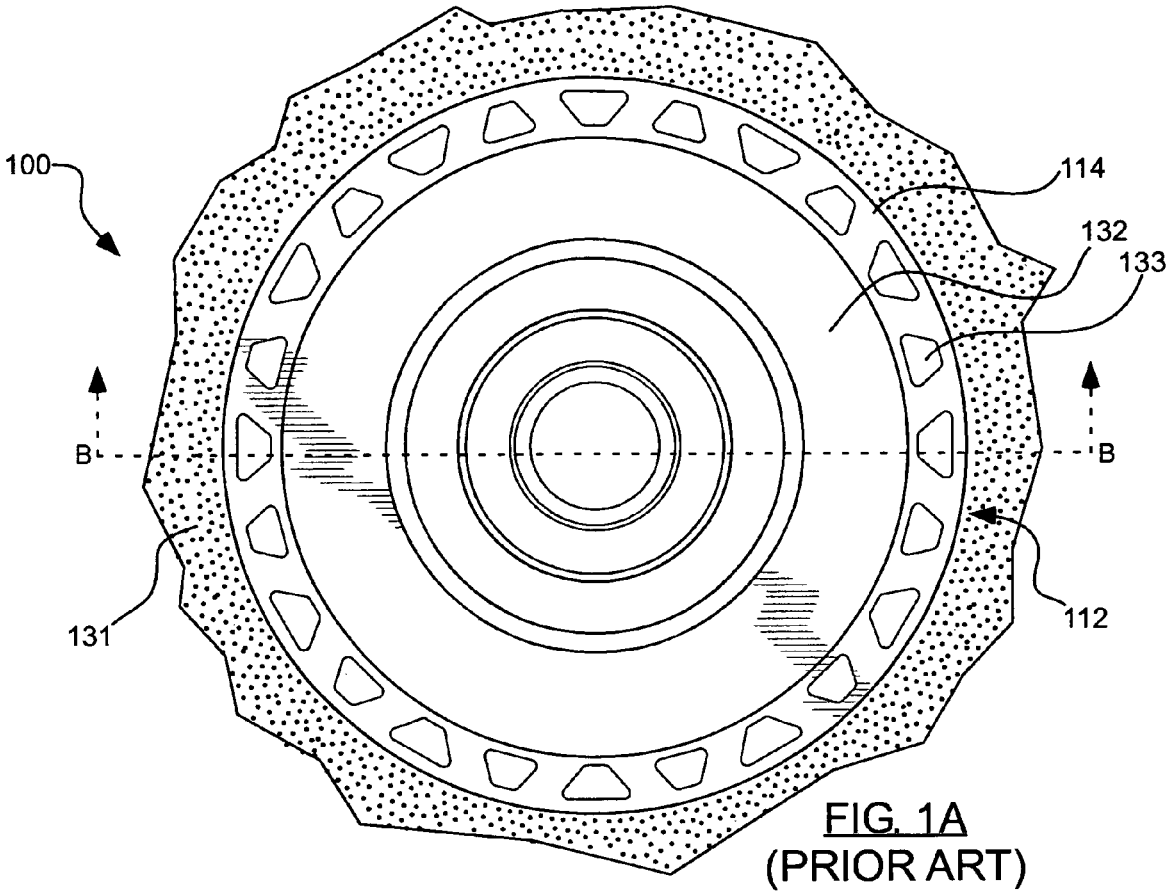
FIG. 1A (PRIOR ART)
FIG. 1A is a top, plan view of a PRIOR ART integrated bonding flange shower drain installed within a subfloor.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a drain fitting can include one or more of such drain fittings.

Definitions

In describing and claiming the present invention, the following terminology will be used in accordance with the definitions set forth below.

As used herein, the term "subfloor" is to be understood to refer to flooring structure of a dwelling through which a shower drain is to be installed. Examples of subfloors include flooring surfaces formed of plywood, particle board, concrete, and the like. It is to be understood that the term subfloor is not to be limited by any commonly used meaning ascribed to the term by any particular field of construction or architectural endeavor.

As used herein, the term "integrated bonding flange drain" is to be understood to refer to drain fittings designed for use with a waterproofing membrane. One example of such an integrated bonding flange drain includes, without limitation, the integrated bonding flange drain sold by Schluter Systems companies under the trade name KERDI-DRAIN.

As used herein, the terms "upper," "lower," "elevation," "height," and the like, are to be understood to refer to relative locations and/or displacements of various elements or components relative to a condition in which a mock drain (or an integrated bonding flange) is oriented in its usable, upright orientation. These such terms are used to more clearly claim and describe the various elements or components of the invention and are not to be construed as limiting the invention to any particular embodiment. In the upright orientation, the mock drain (or the integrated bonding flange) will be oriented so as to be operably installable within the subfloor and operably attachable to the plumbing dictated by a particular installation.

As used herein, the terms "substantial," or "substantially," refer to the functional achievement of a desired purpose, operation, or configuration, as though such purpose or configuration had actually been attained. Therefore, a cap section of the mock drain that substantially completely seals another section of the mock drain functions as though, or nearly as though, the cap section completely seals the other section.

Furthermore, when used in an exclusionary context, such as a material "substantially lacking" or being "substantially devoid of, or free of" an element, the terms "substantial" and "substantially" refer to a functional deficiency of the element to which reference is being made. Therefore, it may be possible that reference is made to a material in which an element is "substantially lacking," when in fact the element may be present in the material, but only in an amount that is insufficient to significantly affect the material, or the purpose served by the material in the invention.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 5 inches" should be interpreted to include not only the explicitly recited values of about 1 inch to about 5 inches, but also include individual values and sub-ranges within the indicated range. This same principle applies to ranges reciting only one numerical value and should apply regardless of the breadth of the range or the characteristics being described.

Invention

Figure 1B:
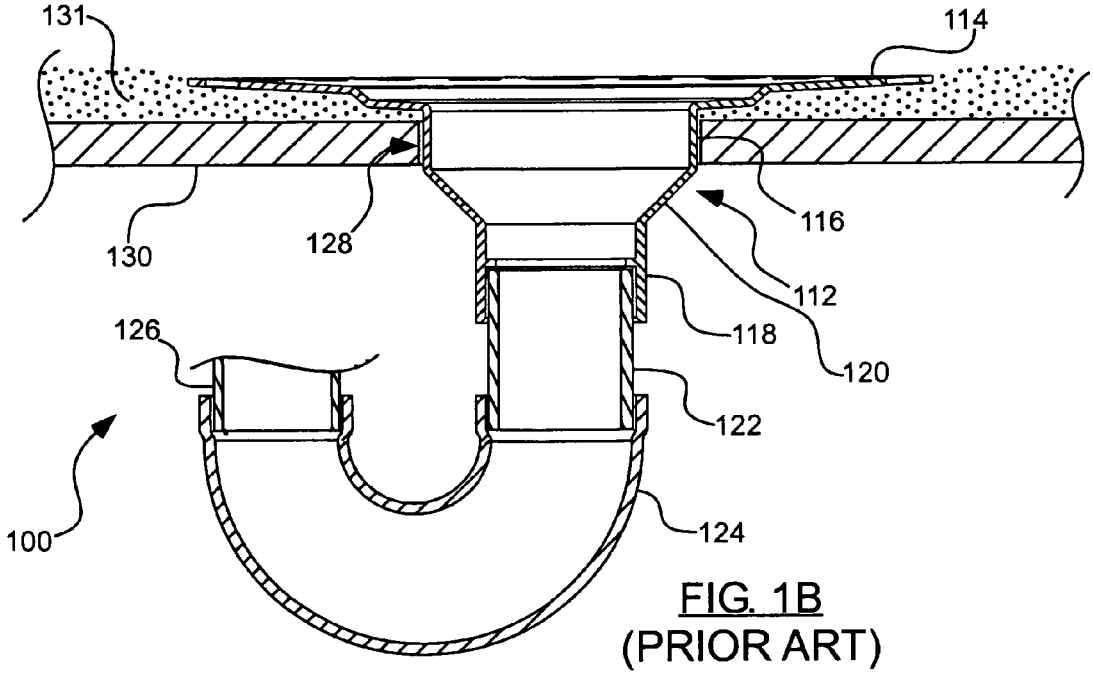
FIG. 1B (PRIOR ART)
FIG. 1B is a side, sectional view of the PRIOR ART integrated bonding flange shower drain of FIG. 2A, taken along section B-B of FIG. 1A.

Illustrated generally at 100 in FIGS. 1A and 1B is a conventional, prior art system that can be used to provide drainage for tile installations in shower and bath areas of various dwellings. The conventional system shown can incorporate products sold by the Schluter Systems companies under the trade name KERDI-DRAIN. To simplify the discussion herein, the term "drain" will sometimes be used to refer to the integrated bonding flange drain, with the understanding that such usage is specific to the features and designs of integrated bonding flange drains, but not necessarily to other types of drains (e.g., the term "drain" does not include reference to drains commonly known as "two-piece" drains).

In general, the conventional system 100 includes an integrated bonding flange drain 112 that includes an upper flange 114 to which a bonded waterproof membrane (not shown) can be adhered. The integrated bonding flange drain includes an upper section 116 and a lower section 118. An intermediate section 120 can intercouple the upper section and the lower section. In a typical installation, a cavity 128 is generally formed in a subfloor 130 under which various components of a conventional plumbing system are disposed. Once the various components of the plumbing system are installed, and the cavity has been formed in the subfloor, a mortar bed 131 (or some suitable, equivalent structure, such as foam sheeting designed for the purpose) can be laid or applied by a tile setter. The mortar bed generally slopes, at least to some minor degree, toward the center of the drain to ensure that the tile (not shown) that is laid over the mortar bed slopes toward the drain to ensure proper runoff of water to and into the drain.

Preferably, it is only after the mortar bed 131 has been prepared that the integrated bonding flange drain 112 is installed within the drain fitting 122 and properly seated on or within the mortar bed. A series of openings 133 is often formed around the perimeter of the flange 114 of the drain to aid in securing the flange on or in the mortar bed. A fleece webbing 132 is typically adhered over a large surface of the flange 114 of the drain. A bondable (or bonded) waterproof membrane (not shown) can typically be adhered to the fleece webbing to ensure a completely watertight installation of the waterproof membrane to the drain.

The lower section 118 of the integrated bonding flange drain 112 can be coupled to the plumbing system of the dwelling by way of drain fitting 122. The drain fitting can be coupled to gooseneck 124, which can be in turn coupled to a remaining portion 126 of the plumbing system. The specific details of the plumbing system are generally well known in the art and are not expounded upon herein in detail.

It will be appreciated that the spacing of the flange portion 114 of the drain above an upper surface of the subfloor 130 can affect the integrity of the overall tile installation process. If the flange is disposed too closely to the subfloor, the thickness of the mortar bed may be inadequate. If the flange is disposed too high above the subfloor, the mortar bed may have to be made too thick for a proper installation. Accordingly, it is important that, when the plumbing components are assembled, the drain fitting 122 be installed such that the drain 112, when coupled to the fitting 122 (after the mortar bed has been laid), is disposed in the proper location relative to the subfloor 130.

However, it is generally the plumber who assembles the various components of the plumbing (e.g., "plumbs" the shower), and not the tile setter. In addition, the plumber generally plumbs the shower many days, weeks, or even months before the tile setter finishes the installation by installing the drain 112, the bondable waterproof membrane, the tile and grout, etc. Accordingly, in the past it has been difficult for the plumber to properly install the various plumbing components and ensure that the drain 112, when finally coupled to drain fitting 122, will be disposed at the proper elevation. The present invention can be advantageously used to address these shortcomings in prior art systems.

Figure 2A:
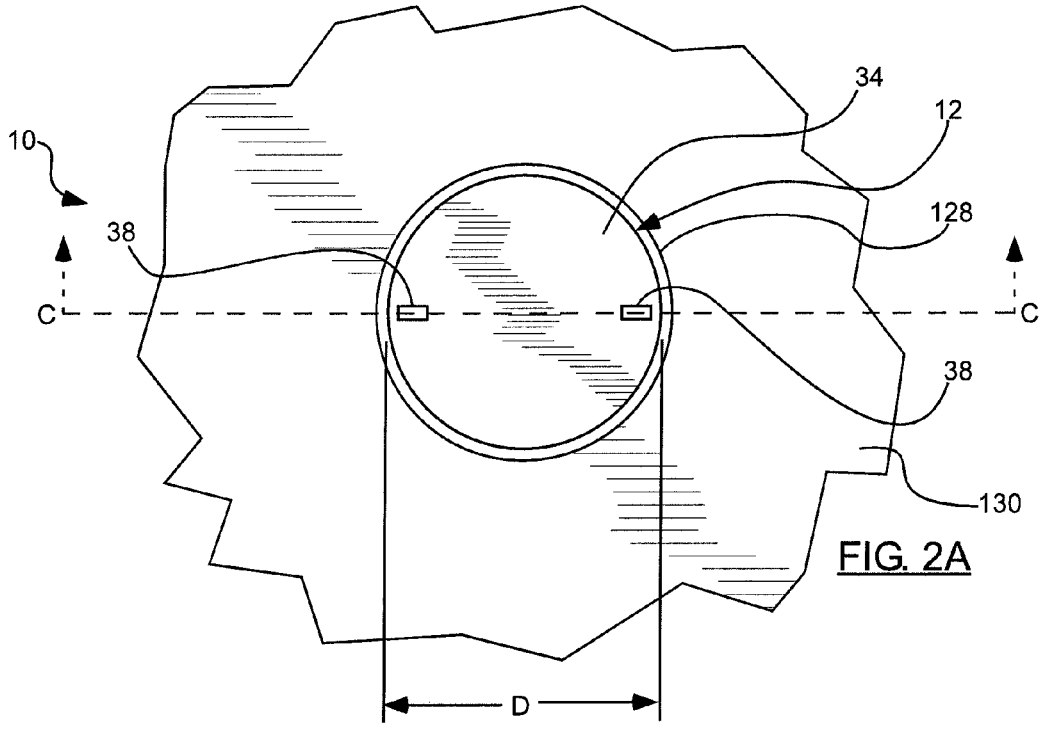
FIG. 2A is a top, plan view of a mock shower drain installed within a subfloor in accordance with one embodiment of the present invention.
Figure 2C:
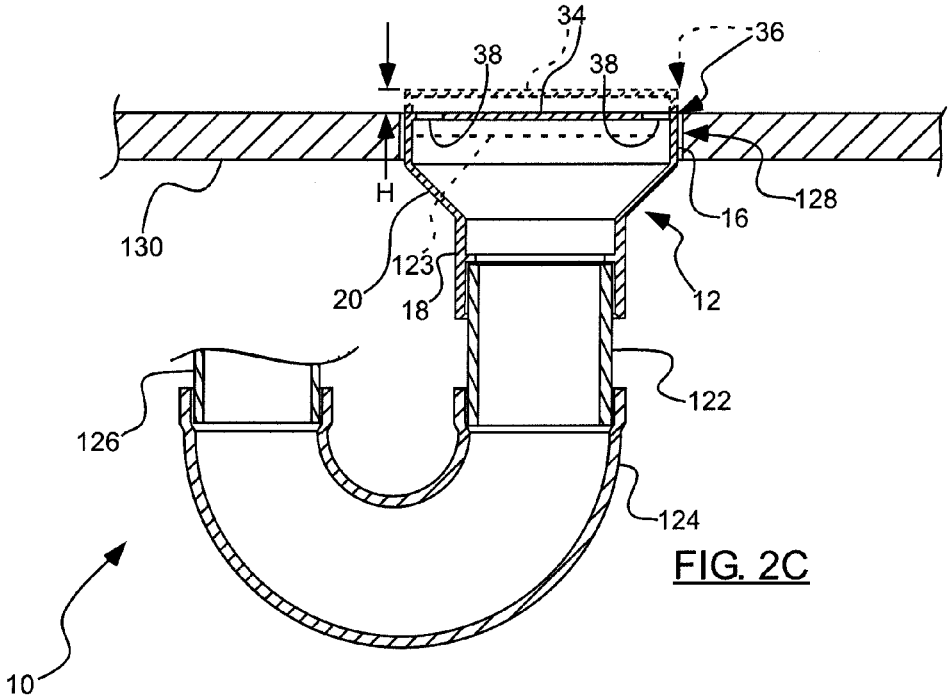
FIG. 2C is a side, sectional view of the mock shower drain of FIG. 2A, taken along section C-C of FIG. 2A.

One embodiment of the present invention is shown in top view in FIG. 2A and in side view in FIG. 2C. The invention provides a mock shower drain 12 for temporary, in-situ installation within a shower area that is configured to utilize an integrated bonding flange drain (112 in FIGS 1A and 1B). The mock shower drain can include a lower section 18 that can be operable to removably mate with the drain fitting 122 installed in the shower area. As discussed above, the drain fitting 122 can be operable to mate with a corresponding lower section (118 in FIG. 1B) of the integrated bonding flange drain.

An upper section 16 of the mock drain 12 can be sized to fit within the cavity 128 formed in the subfloor 130 of the shower area. As discussed above, the cavity can be sized to receive a corresponding section (116 in FIG. 1B) of the integrated bonding flange drain. A cap section 34 can be coupled to the upper section and can form a barrier to aid in resisting passage of debris to and through the drain fitting 122. An intermediate section 20 can intercouple the upper section and the cap section. The mock drain 12 can be dimensioned such that an uppermost portion (shown by example at 36) of the mock drain is elevated at least as high as to be substantially flush with an upper surface of the subfloor 130 of the shower area when the lower section 18 of the mock drain is mated with the drain fitting 122.

The mock drain 12 can be provided to the plumber charged with plumbing the shower area and can be used to ensure that the plumber correctly installs and sizes the various plumbing components of the installation. The mock drain can also ensure that the integrated bonding flange drain (112 in FIGS. 1A and 1B) does not become damaged after the plumber has completed his or her job, as the integrated bonding flange drain need not be left in place during the time interval between the time when the plumber has finished his or her job and when the tile setter completes his or her job. As discussed above, the integrated bonding flange drain 112, when installed correctly, is disposed slightly above the subfloor 130 and rests on mortar bed 131 (or an equivalent structure). Thus, until the tile setter installs the mortar bed, the drain 112 is not properly supported by the subfloor and can be susceptible to side-to-side "rocking" movement (or vertical movement), which movement can result in damage being done to the drain or to the plumbing components.

In the past it has been found that plumbers have, at times, failed to set the various plumbing components into the correct position, resulting in the drain 112 not properly fitting in the drain fitting 122 when the tile setter arrives to finish the shower installation. When this has happened, the tile setter has had to either repair the plumber's installation prior to proceeding with his or her portion of the work, or has had to wait while someone else does the repair. The present inventor has found, however, that if a plumber utilizes the mock drain 12 when installing the plumbing components, the tile setter is much more likely to arrive at the job site with the plumbing components properly installed. The tile setter can simply remove the mock drain when he or she is ready to proceed with the shower installation with the knowledge that the plumbing will properly accommodate the drain 112 when it is time to install the drain.

To aid the tile setter in removing the mock drain 12, one or both of the top section 16 and the cap section 34 can include engagement structure 38 that can be configured to be engaged by the tile setter (or his or her assistant) to withdraw the mock drain from the drain fitting 122 prior to installing the integrated bonding flange drain 112 in the drain fitting. The engagement structure can take a variety of forms and can be operable to facilitate application of a rotating motion to the mock drain by the user (e.g., to twist or unscrew the mock drain from the drain fitting), and/or can be operable to facilitate application of a translational motion to the mock drain by the user (e.g., to allow the tile setter to remove the mock drain from the drain fitting). In the embodiment shown in the figures, the engagement structure includes a pair of slots 38 that can be engaged by one or more hook-shaped tools (not shown) to allow the tile setter to pull and/or twist the mock drain from the drain fitting 122. In addition to general slot structure, it is contemplated that the engagement structure can include protrusions that can be engaged by hand or by tool, or can include one or more apertures large enough to enable an operator to engage the mock drain with his or her fingers, etc.

In one embodiment of the invention the cap section 34 can be removably attached to the upper section 16 of the mock drain 12 by way of a removable press fit, snap-fit or by use of fasteners such as screws, bolts, etc. (not shown in the figures). In this manner, the engagement structure can be disposed within the mock drain and can be accessed by removing the cap from the mock drain. The cap section can cover a majority of open space defined by the upper section 16 to substantially completely seal the upper section to ensure that debris does not enter the drain fitting 122 (and thus the plumbing system) while the mock drain is installed in the drain fitting. When slots 38 are utilized to facilitate relatively easy removal of the mock drain, it is contemplated that "trap" sections (not shown) can be formed beneath the slots to ensure that any debris that enters the slots is not allowed to fall into or through the drain fitting 122.

The upper section 16 of the mock drain 12 can include a diameter ("D," in FIG. 2A) that is equal to or greater than a diameter of a corresponding section 116 of the integrated bonding flange drain 112. In one aspect of the invention, the diameter of the upper section can be formed slightly larger than a diameter of the upper section 116 of the drain 112. In this manner, concrete can be poured about the mock drain and allowed to cure. The mock drain can then be removed from the cured concrete (possibly requiring the use of one or more removal tools), and the resulting cavity 128 formed in the concrete will be slightly larger than the diameter of the upper section 116 of the drain 112, allowing the tile setter to snugly but easily install the drain through the cavity formed in the concrete.

As shown in FIG. 2C, the mock drain 12 can be dimensioned such that an upper portion (shown generally at 36) of the mock drain is flush with, or elevated slightly higher than (as shown by height indicator "H"), an upper surface of the subfloor 130 when the mock drain is installed in the drain fitting 122. The mock drain can include indicia 123 disposed thereon that can include instructions to a plumber relating to a height relative to the subfloor that the mock drain should be installed. The indicia can include, but is not limited to, a demarcation (e.g., a line) formed or marked on a side of the upper section 16 that indicates a level to which the upper section should be aligned with the upper portion of the subfloor.

The subfloor 130 illustrated in the figures is generally a wooden structure such as plywood or particle board. It is to be understood, however, that the mock drain 12 can also be used in installations in which the subfloor is concrete, as might be the case, for example, when the shower area is disposed in a concrete slab of a home, or in outside applications near pools, etc. In addition, while the intermediate section 20 of the mock drain is shown having generally tapering side walls, it is to be understood that the shape of the intermediate section can vary, and can include, for example, a generally rounded "bowl" shape.

It is to be understood that, to function best, the mock drain 12 should be installed by the plumber on or over the drain fitting 122 in a manner that allows the mock drain to be relatively easily removed at a later time. If, for example, the plumber accidentally bonds the mock drain within the drain fitting, the tile installer can be faced with a very difficult extraction process. To minimize the possibility of this type of mistake, the present invention can include structure that forces or encourages the plumber to attach the mock drain to the plumbing system in a removable manner, e.g., in a manner that allows removal of the mock drain without damage being done to the drain fitting or to the supporting plumbing system, including the drain fitting 122.

Figure 3:
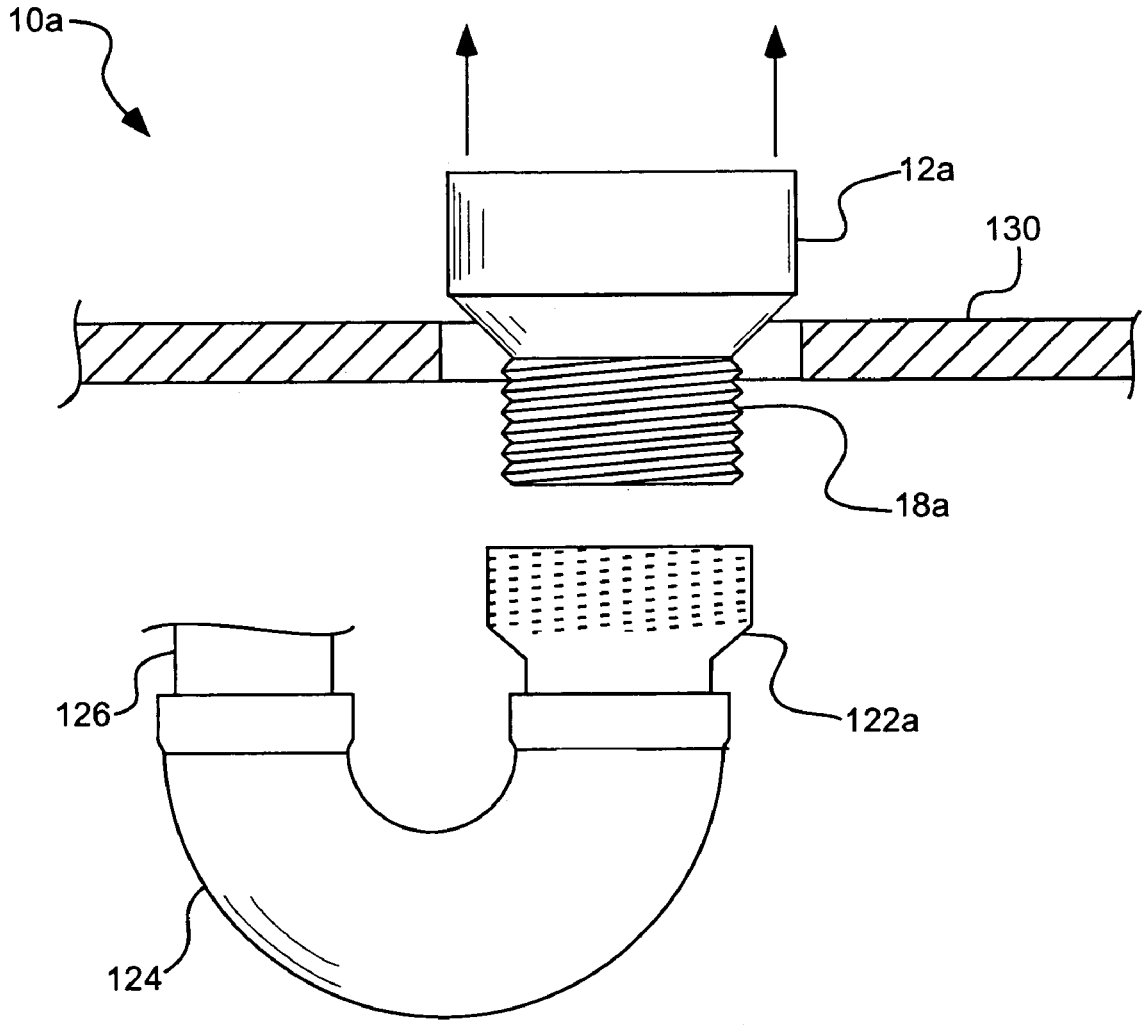
FIG. 3 is a side view of a mock shower drain in accordance with another aspect of the present invention.

As shown in FIG. 3, in one embodiment of the invention, a mock drain 12*a* is provided that can include a lower, threaded portion 18*a* that can be configured to threadably mate with threaded drain fitting 122*a*. In this aspect, the plumber can simply threadably engage the mock drain with the drain fitting 122*a* to ensure that the mock drain can be later removed by the tile setter. This aspect of the invention can be advantageously used when an integrated bonding flange drain (not shown) having a lower threaded portion is to be utilized in the shower installation. This embodiment of the invention also allows the tile setter to make minor and/or incremental adjustments to an elevation of the finally-installed integrated bonding flange drain by threading the drain upwardly or downwardly in the threaded drain fitting.

In addition to the structural features discussed above, the present invention also provides a method for preparing a shower area to receive an integrated bonding flange drain prior to installing the integrated bonding flange drain, including: ensuring that suitable plumbing exists below a subfloor of the shower area to accommodate the integrated bonding flange drain, the plumbing including at least a drain fitting operable to mate with a lower section of the integrated bonding flange drain; ensuring that a suitable opening is formed in the subfloor through which the integrated bonding flange drain can be disposed when accommodated by the plumbing; temporarily installing within the drain fitting a lower section of a mock drain; and orienting an upper section of the mock drain such that an uppermost section of the mock drain is elevated at least as high as to be substantially flush with the subfloor of the shower area when the lower section of the mock drain is mated with the drain fitting.

Orienting the upper section of the mock drain can include orienting the mock drain such that no portion of the mock drain other than the uppermost portion of the mock drain extends above the subfloor. Orienting the upper section of the mock drain can also include orienting the uppermost portion of the mock drain substantially flush with an upper level of the subfloor.

Withdrawing the mock drain from the drain fitting can include i) threadably rotating the mock drain from the drain fitting and/or ii) slidably withdrawing the mock drain from the drain fitting.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A mock shower drain for temporary, in-situ installation within a shower area that is configured to utilize an integrated bonding flange drain, the mock shower drain comprising:

a lower section operable to mate with a drain fitting installed in the shower area, the drain fitting operable to mate with a corresponding lower section of an integrated bonding flange drain;

an upper section sized to fit within a cavity formed in a subfloor of the shower area that is sized to receive a corresponding section of the integrated bonding flange drain;

a cap section, coupled to the upper section, the cap section forming a barrier to resist passage of debris into the mock drain, the cap section substantially completely sealing the upper section; and an intermediate section, intercoupling the upper section and the lower section;

the mock drain being dimensioned such that an uppermost portion of the mock drain is elevated at least as high as to be substantially flush with an upper surface of the subfloor of the shower area when the lower section of the mock drain is mated with the drain fitting.

2. The mock drain of claim 1, wherein one of the upper section and the cap section includes engagement structure configured to be engaged by a user to withdraw the mock drain from the drain fitting prior to installing the integrated bonding flange drain in the drain fitting.

3. The mock drain of claim 2, wherein the engagement structure is operable to facilitate application of a rotational motion to the mock drain by the user.

4. The mock drain of claim 2, wherein the engagement structure is operable to facilitate application of a translational motion to the mock drain by the user.

5. The mock drain of claim 2, wherein the engagement structure is disposed in or coupled to the cap section.

6. The mock drain of claim 1, wherein the upper section includes a diameter equal to or greater than a diameter of a corresponding section of the integrated bonding flange drain.

7. The mock drain of claim 1, further comprising indicia, disposed on the mock drain, the indicia instructing an installer of the mock drain of a height relative to the subfloor to which the uppermost portion of the mock drain should be elevated.

8. The mock drain of claim 1, wherein the cap section is removably attached to the upper section of the mock drain.

9. A mock shower drain for temporary, in-situ installation within a shower area that is configured to utilize an integrated bonding flange drain, the mock shower drain comprising:

a lower section operable to mate with a drain fitting installed in the shower area, the drain fitting operable to mate with a corresponding lower section of an integrated bonding flange drain;

an upper section sized to fit within a cavity formed in a subfloor of the shower area that is sized to receive a corresponding section of the integrated bonding flange drain;

a cap section, coupled to the upper section, the cap section forming a barrier to resist passage of debris into the mock drain, the barrier blocking at least about 95% or more of the upper section from flow of debris into the mock drain; and an intermediate section, intercoupling the upper section and the lower section;

the mock drain being dimensioned such that an uppermost portion of the mock drain is elevated at least as high as to be substantially flush with an upper surface of the subfloor of the shower area when the lower section of the mock drain is mated with the drain fitting.

10. The mock shower drain of claim 9, wherein the cap section substantially completely seals the upper section.

11. The mock shower drain of claim 9, wherein the cap section completely seals the upper section.

12. The mock shower drain of claim 9, wherein the barrier blocks at least about 98% or more of the upper section from flow of debris into the mock drain.

13. A mock shower drain for temporary, in-situ installation within a shower area that is configured to utilize an integrated bonding flange drain, the mock shower drain comprising:

a lower section operable to mate with a drain fitting installed in the shower area, the drain fitting operable to mate with a corresponding lower section of an integrated bonding flange drain;

an upper section sized to fit within a cavity formed in a subfloor of the shower area that is sized to receive a corresponding section of the integrated bonding flange drain;

a cap section, coupled to the upper section, the cap section forming a barrier to resist passage of debris into the mock drain, the cap section completely sealing the upper section; and an intermediate section, intercoupling the upper section and the lower section;

the mock drain being dimensioned such that an uppermost portion of the mock drain is elevated at least as high as to be substantially flush with an upper surface of the subfloor of the shower area when the lower section of the mock drain is mated with the drain fitting.

* * * * *